US006210211B1

(12) United States Patent
Landrum et al.

(10) Patent No.: US 6,210,211 B1
(45) Date of Patent: Apr. 3, 2001

(54) METHOD AND APPARATUS FOR RETAINING AN ELECTRICAL CONNECTOR

(75) Inventors: Gary Landrum, Montgomery; Michael Owens, Tomball, both of TX (US)

(73) Assignee: Compaq Computer Corporation, Houston, TX (US)

( * ) Notice: Subject to any disclaimer, the term of this patent is extended or adjusted under 35 U.S.C. 154(b) by 0 days.

(21) Appl. No.: 09/390,257

(22) Filed: Sep. 3, 1999

(51) Int. Cl.[7] ..... H01R 13/72
(52) U.S. Cl. ..... 439/501
(58) Field of Search ..... 439/501; 174/69; 361/686, 826, 827

(56) References Cited

U.S. PATENT DOCUMENTS 5,769,514 * 6/1998 Brown et al. ..... 312/195

FOREIGN PATENT DOCUMENTS

0282389 * 2/1988 (DE) .

* cited by examiner

*Primary Examiner*—Gary F. Paumen
*Assistant Examiner*—Phuongchi Nguyen
(74) *Attorney, Agent, or Firm*—William, Morgan & Amerson

(57) ABSTRACT

In one aspect of the present invention, an apparatus for retaining an electrical connector is provided. The apparatus includes a tray adapted to receive an electrical device having a flexible connector coupled thereto. The tray is moveable between first and second positions. A spring extends between the tray and the flexible connector. The spring urges the flexible connector into a serpentine configuration in the first tray position.

10 Claims, 3 Drawing Sheets

METHOD AND APPARATUS FOR RETAINING AN ELECTRICAL CONNECTOR

BACKGROUND OF THE INVENTION

1. Field of the Invention

The present invention is generally related to flexible electrical connectors, and, more particularly, to a method and apparatus for storing an electrical connector between moveable parts.

2. Description of the Related Art

Electronic devices are commonly formed from a plurality of parts that may be moveable relative to one another, but need to be electrically joined together. For example, a telephone normally consists of a base unit and a handset joined together by an electrical connector, such as a cable. Ordinarily, the telephone cable is formed in a helical coil so that it is at least somewhat self-storing. That is, telephone cables as long as several feet may be useful to provide a limited range of mobility to the telephone user; however, storing several feet of cable may be inconvenient and cumbersome. The helical construction of the cable is expandable/compressible so that when not in use, a large quantity of cable can be stored in a relatively small area, and when in use, the cable can be dramatically expanded to extend the range of use of the telephone.

Other electronic devices are constructed from multiple moveable parts that have benefited from an expandable/compressible connection, such as that used in a telephone. For example, personal computers are routinely constructed with a moveable keyboard that is electrically connected to a tower. Often, the electrical connection between the keyboard and tower is formed in a helical coil to be at least partially self-storing. Personal computers are routinely located on furniture and/or racks where the keyboard is stored in a sliding tray. The helical coil connector for the keyboard is usually sufficiently flexible that it cannot support its own weight, and tends to sag. The sliding mechanism associated with the tray can capture and pinch the connector, damaging the connector, particularly where the sliding motion is repetitive.

The present invention is directed to a method and apparatus that solves or reduces some or all of the aforementioned problems.

SUMMARY OF THE INVENTION

In one aspect of the present invention, an apparatus for retaining an electrical connector is provided. The apparatus includes a tray adapted to receive an electrical device having a flexible connector coupled thereto. The tray is moveable between first and second positions. A spring extends between the tray and the flexible connector. The spring urges the flexible connector into a serpentine configuration in the first tray position.

BRIEF DESCRIPTION OF THE DRAWINGS

The invention may be understood by reference to the following description taken in conjunction with the accompanying drawings, in which like reference numerals identify like elements, and in which.

Figure 1:
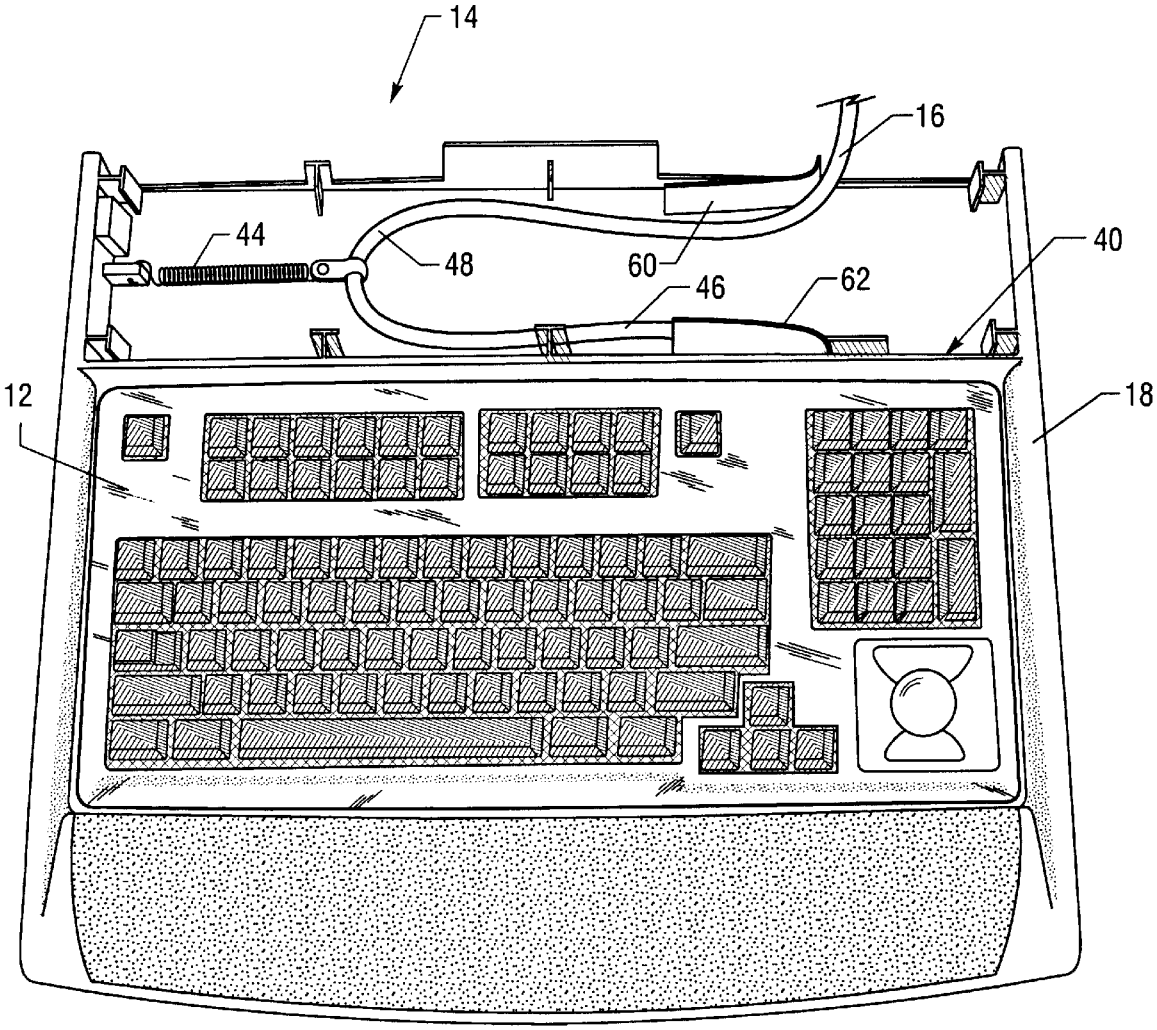
FIG. 1 is a top view of a keyboard and electrical connector retainer assembly in a first operational position.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning now to the drawings, and in particular to FIG. 1, a top view of a keyboard 12 and a retainer assembly 14 for an electrical connector 16 is shown in a first operational position within a tray or drawer 18. The keyboard 12 is of a conventional configuration, and may take on any of a wide variety of styles, including, but not limited to, standard and enhanced keyboards, ergonomic keyboards, and the like. Further, the instant invention may also find application to a wide variety of other computer peripheral devices, such as mice, trackballs, and the like.

Figure 2:
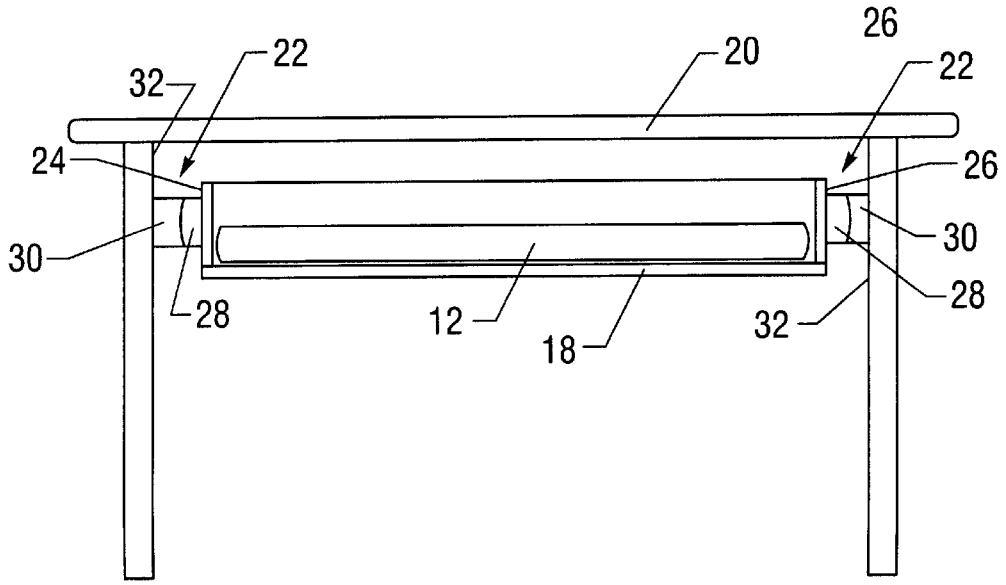
FIG. 2 is a front view of the keyboard within a unit.

As shown in FIG. 2, the keyboard 12 is positioned in the tray 18 of a unit or housing 20, such as a computer stand or rack. The tray 18 is coupled to the unit 20 through a pair of conventional slides 22 disposed along opposite sides 24, 26 of the tray 18. The slides 22 generally include a moveable and fixed portion 28, 30. The fixed portions 30 are attached to sidewalls 32 of the unit 20, while the moveable portions 28 are attached to the opposite sides 24, 26 of the tray 18. The moveable and fixed portions 28, 30 engage one another such that a sliding movement therebetween is provided. The slides 22 allow the tray 18 to translate linearly out of the unit 20 for easy access by a computer user, and into the unit 20 for storage. Movement of the tray 18 necessarily produces similar movement of the keyboard 12, extending the connector 16 therewith.

Referring again to FIG. 1, the connector 16 is electrically and physically coupled to another component (not shown), such as a tower or the like, located adjacent or in the unit 20 (See FIG. 2). In the illustrated embodiment, the connector 16 takes the form of a conventional flexible cable having a plurality of electrically conductive wires (not shown) housed in a flexible insulated sheath (not shown). The sheath assists in protecting the smaller conductive wires from being crimped, pinched, or otherwise damaged during normal operation and movement of the keyboard 12. Ordinarily, the connector 16 exits the keyboard 12 adjacent a first end portion 40 thereof and extends to the rear or side of the unit 20 where it is electrically and physically connected to the other component (not shown)

In the illustrated embodiment, the retainer assembly 14 is coupled to the sidewall 24 of the tray 18 opposite the end portion 40 of the keyboard 12. That is, the retainer assembly 14 is spaced a substantial distance from the exit point of the connector 16 from the keyboard 12. This spacing allows the retainer assembly 14 to store a substantial length of the connector 16 free from entanglement with the tray 18 and slides 22 to allow for substantial free sliding movement of the tray 18 and keyboard 12.

The retainer assembly 14 includes a spring 44, such as a coil spring, coupled between the sidewall 24 of the tray 18 and the connector 16. The connector 16 is fixedly held at a first end portion 46 by the keyboard 12, and at a second end portion 48 by the retainer assembly 14. The length of the connector 16 between the first and second end portions 46, 48 is at least as long as the range of motion of the tray 18. That is, when the tray 18 is stored in the unit 20, as shown in FIG. 1, substantial slack exists in the connector 16, which would sag if not restrained by the spring 44. The spring 44 urges the connector 16 into a serpentine configuration extending laterally across the unit 20 behind the tray 18. Thus, the connector 16 is stored in the serpentine configuration, spaced from the slides 22 and free from pinching by the tray 18, the slides 22, and/or any equipment (not shown) located below the tray 18.

Figure 3:
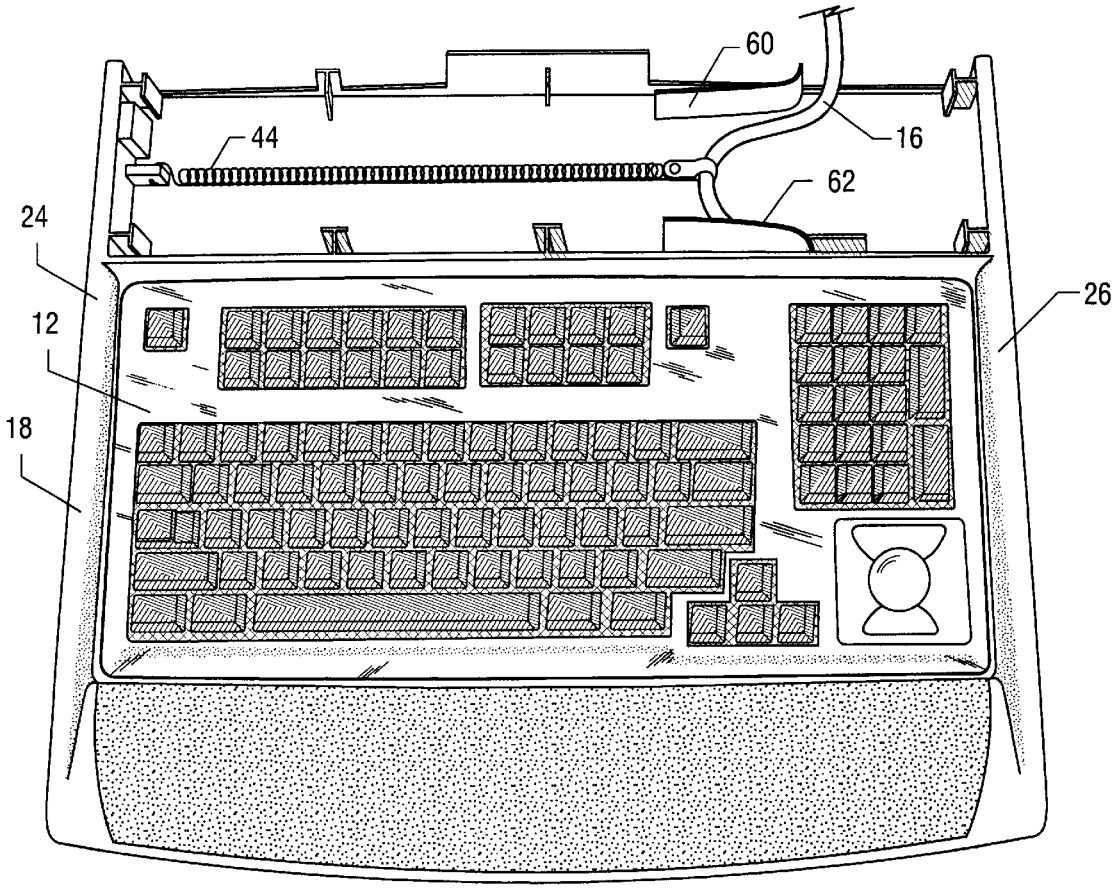
FIG. 3 is a top view of a keyboard and electrical connector retainer assembly in a second operational position.

When the tray 18 is extended from the unit 20, such as is show in FIG. 3, the connector 16 is urged into a more linear configuration, stretching the spring 44. Thus, whether the tray 18 is stored or extended, the connector 16 remains substantially disposed in the plane of the tray 18 and free from interference with the moving slides 22 and/or any equipment (not shown) located below the tray 18.

Figure 4:
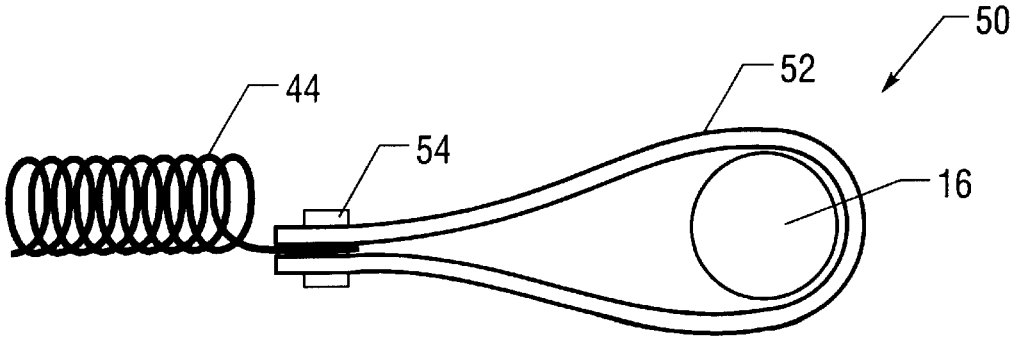
FIG. 4 is a side view of a connection between assembly and the electrical connector.

In the illustrated embodiment, the spring 44 is coupled to the connector 16 via a sliding connection 50, such as is show in FIG. 4. The sliding connection 50 consists of a generally rectangular tab 52 folded back upon itself to form a generally loose loop configuration. The generally rectangular tab 52 is held in this loose loop configuration by a connector 54 extending through both end portions of the generally rectangular tab 52. The connector 54 can take on a variety of conventional configurations, such as rivets, screws, brads, and the like. Additionally, the connector 54 also engages an end portion of the spring 44 to capture the generally rectangular tab 52 in its loop configuration to an end portion of the spring 44. The loop configuration of the generally rectangular tab 52 has a sufficient diameter to receive the connector 16 therein with a sufficiently loose fit to allow sliding movement of the connector 16 within the generally loop configuration of the generally rectangular tab 52. Thus, as the keyboard 12 and tray 18 are translated between the position shown in FIGS. 1 and 3, the connector 16 is pulled into its more linear configuration, as shown in FIG. 3, urging the spring 44 to its extended position. During this movement, the connector 16 freely slides through the open loop configuration of the generally rectangular tab 52.

As can be seen in FIGS. 1 and 3, a pair of guides 60, 62 are attached to or integrally formed with the tray 18 adjacent the exit point of the connector 16 from the keyboard 12. The guides 60, 62 are curvilinear in configuration so as to provide a relatively smooth, curved surface against which the spring 44 holds the connector 16. The smooth, curved surface of the guides 60, 62 reduces the possibility of damage to the connector 16 during its movement between the relatively linear configuration FIG. 3 and the serpentine configuration of FIG. 1. Additionally, the relatively smooth, curved surface of the guides 60, 62 reduces friction, which decreases binding between the tray 18 and connector 16.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An apparatus for retaining a flexible connector, comprising:

a tray adapted to receive an electrical device having the flexible connector coupled thereto, said tray being moveable in a first direction between first and second positions; and a spring adapted to extend between said tray and said flexible connector in a direction generally transverse to the first direction, said spring urging said flexible connector into a serpentine configuration in said first tray position; and a sliding connection positioned between said flexible connector and said spring wherein said flexible connector is relatively free for movement therethrough.

2. An apparatus, as set forth in claim 1, wherein said sliding connection includes a generally rectangular tab having first and second end portions coupled together and to said spring, forming a loop configuration.

3. An apparatus, as set forth in claim 1, wherein said spring is coupled to a first end portion of said tray and said flexible connector is connected to said electrical device at a distance spaced from said tray first end portion.

4. An apparatus, as set forth in claim 1, including first and second guides mounted to said tray, said guides having surfaces disposed to engage said connector to reduce friction during movement of said tray between said first and second positions.

5. An apparatus, as set forth in claim 4, wherein said guide surfaces are generally curvilinear.

6. An apparatus, comprising:

a housing;

a tray coupled to said housing and being moveable in a first direction between first and second positions;

an electrical device having a flexible connector coupled thereto, said electrical device being positioned in said tray;

a spring adapted to extend between said tray and said flexible connector in a direction generally transverse to the first direction, said spring urging said flexible connector into a serpentine configuration in said first tray position; and a sliding connection positioned between said flexible connector and said spring wherein said flexible connector is relatively free for movement therethrough.

7. An apparatus, as set forth in claim 6, wherein said sliding connection includes a generally rectangular tab having first and second end portions coupled together and to said spring, forming a loop configuration.

8. An apparatus, as set forth in claim 6, wherein said spring is coupled to a first end portion of said tray and said flexible connector is connected to said electrical device at a distance spaced from said tray first end portion.

9. An apparatus, as set forth in claim 6, including first and second guides mounted to said tray, said guides having surfaces disposed to engage said connector to reduce friction during movement of said tray between said first and second positions.

10. An apparatus, as set forth in claim 9, wherein said guide surfaces are generally curvilinear.

* * * * *